United States Patent [19]

Hahn et al.

[11] Patent Number: 5,076,808

[45] Date of Patent: Dec. 31, 1991

[54] DYEING OF POLYAMIDE SUBSTRATES WITH AN ORGANIC N-NITROSO-HYDROXYLAMINE AS LIGHT STABILIZER

[75] Inventors: Erwin Hahn, Heidelberg; Alexander Aumueller, Deidesheim; Wolfgang Reuther, Heidelberg; Reinhold Krallmann, Weisenheim; Dieter Wegerle, Mannheim, all of Fed. Rep. of Germany

[73] Assignee: BASF Aktiengesellschaft, Ludwigshafen, Fed. Rep. of Germany

[21] Appl. No.: 623,568

[22] Filed: Dec. 7, 1990

[30] Foreign Application Priority Data

Dec. 14, 1989 [DE] Fed. Rep. of Germany ..... 3941295

[51] Int. Cl.[5] ..... D06P 5/02; C09B 67/00

[52] U.S. Cl. ..... 8/442; 8/516; 8/624; 8/917; 8/924

[58] Field of Search ..... 8/442, 624

[56] References Cited

U.S. PATENT DOCUMENTS

| | | | |
|---|---|---|---|
| 4,544,372 | 10/1985 | Heise et al. | 8/602 |
| 4,613,334 | 9/1986 | Thomas et al. | 8/442 |
| 4,655,785 | 4/1987 | Reinert et al. | 8/442 |
| 4,707,161 | 11/1987 | Thomas et al. | 8/442 |
| 4,874,391 | 10/1989 | Reinert | 8/442 |
| 4,902,299 | 2/1990 | Anton | 8/442 |
| 4,990,164 | 2/1991 | Huber-Emden | 8/442 |

FOREIGN PATENT DOCUMENTS

| | | |
|---|---|---|
| 252386 | 1/1988 | European Pat. Off. . |
| 815537 | 6/1959 | United Kingdom . |

*Primary Examiner*—A. Lionel Clingman

*Attorney, Agent, or Firm*—Oblon, Spivak, McClelland, Maier & Neustadt

[57] ABSTRACT

Polyamide substrates are dyed from aqueous baths with suitable dyes and with copper complexes of organic N-nitrosohydroxylamines as light stabilizers for the dyed polyamide.

5 Claims, No Drawings

DYEING OF POLYAMIDE SUBSTRATES WITH AN ORGANIC N-NITROSO-HYDROXYLAMINE AS LIGHT STABILIZER

The present invention relates to an improved process for dyeing polyamide substrates from aqueous baths with suitable dyes and with copper complexes as light stabilizers for the dyed polyamide.

The present invention also relates to dye formulations which contain a copper complex of an organic N-nitrosohydroxylamine as light stabilizer for the dyed polyamide.

It is common knowledge that the light fastness of dyed polyamide deteriorates as a consequence of the catalytic effect of the dye; that is, under the action of light, in particular light and heat, the dyed polyamide undergoes chemical changes which have an adverse effect on the mechanical and thermal properties and also bring about undesirable discolorations.

Therefore, to remedy this disadvantage, light fastness stabilizers have been used in the dyeing, chiefly copper complexes, for example of salicylaldehydes (EP-A-252 368) salicyloximes (EP-A-113 856) and (EP-A-162 811) and water-soluble azo dyes (EP-A-255 481) and of hydroxamic acids (DE-A-3 326 640).

However, the affinity of these complexes leaves something to be desired; that is, for a speedy dyeing the concentration in the dyebath must be higher than the actual amount required, and they also have an overly pronounced intrinsic color, which affects the hue in particular in the case of brilliant dyeings and has a certain dulling effect on the dyeing.

It is an object of the present invention to remedy these disadvantages.

We have found that this object is achieved by a process for dyeing polyamide substrates from aqueous baths with suitable dyes and with copper complexes as light stabilizers for the dyed polyamide, wherein the copper complexes used are those of organic N-nitrosohydroxylamines.

The copper complexes to be used according to the present invention, which conform to the structure I

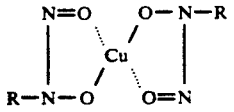

I where R is aliphatic, cycloaliphatic, araliphatic or aromatic, can in principle be derived from any organic N-nitrosohydroxylamine.

For economic reasons, however, preference is given to those complexes I in which R has the following meanings:

- $C_2$–$C_{20}$-alkyl, preferably $C_1$–$C_{10}$-alkyl, especially 2-ethylhexyl and also $C_1$–$C_4$-alkyl such as methyl, ethyl, n-propyl, isopropyl, n-butyl or isobutyl,
- $C_3$–$C_{20}$-alkenyl, preferably $C_3$–$C_6$-alkenyl, such as propenyl, butenyl, pentenyl or hexenyl, or especially oleyl,
- $C_7$–$C_{12}$-aralkyl, preferably benzyl or phenylethyl,
- $C_5$–$C_{12}$-cycloalkyl, preferably $C_5$–$C_7$-cycloalkyl such as cyclopentyl, cycloheptyl or especially cyclohexyl, and aryl such as preferably phenyl.

Of these, the cycloalkyl and aryl groups may in turn carry from 1 to 3 substituents.

Suitable substituents for the cycloalkyl groups are $C_1$–$C_4$-alkyl groups. Preferred alkylcycloalkyl groups are 4-methylcyclohexyl and 4-tert-butylcyclohexyl. For aryl the preferred substituents are as follows:

- especially $C_1$–$C_{12}$-alkyl, $C_1$–$C_{12}$-alkoxy, $C_2$–$C_8$-alkenyl, amino and chlorine,
- also fluorine, bromine, sulfo and radicals of the formulae —CO—O—$R^1$ and —$SO_2$—$R^1$,
- plus hydroxyl, nitro, nitroso and radicals of the formulae —N($R^1$)$R^2$ and —NH—CO—$R^1$, where $R^1$ and $R^2$ are each $C_1$–$C_{12}$-alkyl, phenyl or $C_7$–$C_{12}$-phenylalkyl.

Preferred substituted phenyl is tolyl, 2-, 3- or 4-chlorophenyl, 2-, 3- or 4-bromophenyl, 2-, 3- or 4-fluorophenyl, 2-, 3- or 4-ethylphenyl, 2-, 3- or 4-propylphenyl, 2-, 3- or 4-isopropylphenyl, 2-, 3- or 4-dodecylphenyl, 2-, 3- or 4-methoxyphenyl, 2-, 3- or 4-ethoxyphenyl, 2-, 3- or 4-propoxyphenyl, 2-, 3- or 4-butoxyphenyl, 4-nitrosophenyl, 4-hydroxyphenyl, 4-dimethylaminophenyl, 4-diethylaminophenyl, 4-aminophenyl, phenylsulfonylphenyl, methyloxycarbonyl, ethyloxycarbonyl, propyloxycarbonyl, acetylamino, propionylamino, butanoylamino and pentanoylamino.

The N-nitrosohydroxylamines on which the complexes are based are known or obtainable in a known manner, for example by the action of nitrosating agents such as alkali metal nitrites on N-monosubstituted hydroxylamines (DE-A-10 19 657). The same is true of the preparation of the complexes.

Since the impairment of the light fastness of the dyed polyamides does not depend to any material extent on the chemical structure of the dye, suitable dyes are all those which are suitable for dyeing polyamides, especially dyes with acid groups and disperse dyes.

The dyes can be azo and anthroquinone dyes, metal complexes thereof as well as other metal complex dyes.

Suitable azo dyes are in particular monoazo and bisazo dyes of the benzene-azo-naphthalene, benzene-azo-1-phenylpyrazol-5-one, benzene-azo-benzene, naphthaleneazo-benzene, benzene-azo-aminonaphthalene, naphthaleneazo-naphthalene, naphthalene-azo-1-phenylpyrazol-5-one, benzene-azo-pyridone, benzene-azo-aminopyridine, naphthalene-azo-pyridone, naphthalene-azo-aminopyridine and stilbene-azo-benzene series.

Further dyes of this kind may be found in the Colour Index and in K. Venkataraman, the Chemistry of Synthetic Dyes, Vol. VI, Academic Press, New York, London, 1972. Those of the class of the anthraquinone dyes are described in k. Venkataramen, Vol. II, Academic Press, New York, 1952.

Suitable disperse dyes are in particular metal complex dyes, for example 1:1 or preferably 1:2 complexes of metallized azo, azomethine and phthalocyanine dyes.

The preferred azo and azomethine dyeing complexes are with chromium and cobalt, and those of phthalocyanines with copper and nickel. Examples of the latter class of dyes are given in F. H. Moser, D. L. Thomas, The Phthalocyanines, Vol. II, CRC Press, Boca Raton, Florida 1983.

It is also of course possible to use mixtures of various dyes.

The process according to the present invention is suitable for dyeing any desired polyamide, including for example natural polyamides such as wool and silk, but it has practical importance in particular for dyeing synthetic polyamides such as nylon 6, nylon 6.6 and nylon 12 or materials containing these polyamides.

The substrates may in principle be in any desired form, for example in the form of injection moldings, films, ribbons and fibers, but they will be primarily in the form of fibrous structures such as yarns, webs and chiefly textiles.

The dyeing process is carried out in a conventional manner from the aqueous bath under the conditions recommended for the particular dyes, making further details superfluous.

If the dyes are water-insoluble dyes or copper complexes, it is advantageous to include a dispersant.

The amount to be used of copper complex according to the present invention generally varies in the case of polyamide textile material with the nature of the material and the applied amount of dye within the range from 0.01 to 2% by weight of copper, based on the amount of polyamide in the textile material. This quantity (the amount of copper) determines the minimum concentration of complex to be used in the dyebath, the actual concentration used being advantageously determined in such a way, owing to the excellent affinity, that the spent dyebath is left with only 0.001-1% by weight of copper in the form of the complex. In the case of other substrates, the amounts of dye and complex required must be determined in a few preliminary experiments.

The treatment with the copper complex is normally carried out simultaneously with the dyeing process, but it is also possible to apply the complex to the substrate from a separate bath before or after the dyeing.

If simultaneous application is to be employed, it is advantageous to make available for this purpose ready-to-use dye formulations which contain the dyes with or without dispersants and any other customary assistants and also the complexes.

The process according to the present invention is very important for the dyeing of polyamide textiles which are exposed not only to light to a particular degree but also to heat, chief examples of which are the fabrics for the seats and interior trim of automotive vehicles. The lower intrinsic color of the complexes makes it possible to dye the fabrics in brighter shades than before.

EXAMPLE 1

100 g of a nylon 6.6 yarn were dyed for 60 minutes at the boil in 2 l of an aqueous liquor, adjusted with acetic acid to pH 5, containing

- 0.5 g of the dark blue 1:2 chromium complex dye of Colour Index No. 15707,
- 0.05 g of the green anthraquinone dye of Colour Index No. 61570,
- 0.45 g of the blue anthraquinone dye N,N'-bis(4-amino-3sulfoanthraquinoyl)-4,4'-diaminodiphenylmethane,
- 0.5 g of dispersant (oleylamine ethoxylated with 12 mol of ethylene oxide), and
- 0.5 g (=0.009 g of Cu) of a copper complex of N-nitrosocyclohexylhydroxylamine (I, R=cyclohexyl).

The yarn thus dyed has a high light fastness and a brilliant shade.

EXAMPLE 2

100 g of a nylon 6.6 fabric were dyed for 40 minutes at 115° C. in an autoclave with a liquor, adjusted to pH 4.5, containing

- 0.7 g of the yellow 1:2 chromium complex dye of the formula

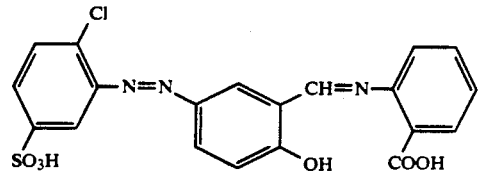

- 0.3 g of the reddish violet 1:2 chromium complex azo dye of Colour Index No. 18762, and
- 0.5 g of dispersant (oleylamine ethoxylated with 12 mol of ethylene oxide).

After subsequent rinsing and rying, the fabric was impregnated with a liquor containing per liter of water 1 g (=0.188 g of Cu) of the copper complex of N-nitrosophenylhydroxylamine (I, R=phenyl).

The brownish orange dyeing thus obtained, compared with a non-aftertreated dyeing, had a distinctly improved light fastness as measured by the Fakrotest of German Standard Specification DIN 75 202.

EXAMPLE 3

100 g of nylon 6 fiber were dyed for 60 minutes at the boil in 2 l of an aqueous liquor, adjusted with monosodium phosphate and acetic acid to pH 6, containing 0.04 g of the brown 1:2 chromium mixed complex azo dye of the formula

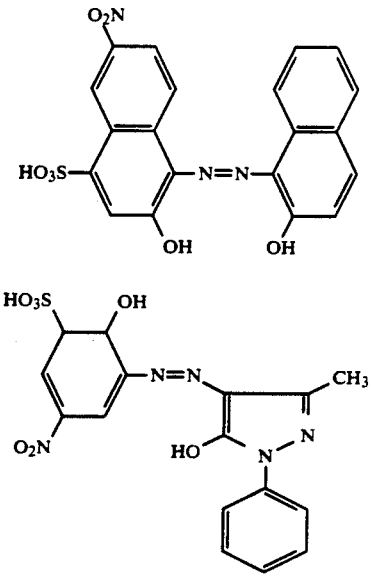

- 0.04 g of the olive-colored 1:2 cobalt complex azo dye of the formula

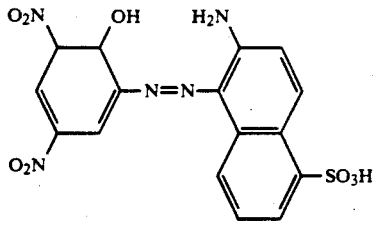

0.05 g of dispersant (oleylamine ethoxylated with 12 mol of ethylene oxide), and 0.1 g (=0.018 g of Cu) of the copper complex of N-nitrosocyclohexylhydroxylamine (I, R=cyclohexyl).

The gray dyeing thus produced showed significantly improved light fastness in the Fakrotest of German Standard Specification DIN 75 202 compared with a similar dyeing without the addition of the copper complex.

We claim:

1. A process for dyeing a polyamide substrate from an aqueous bath with a suitable dye and with a copper complex as light stabilizer for the dyed polyamide, which comprises using the copper complex of an organic N-nitrosohydroxylamine.

2. A process as claimed in claim 1, wherein the copper complex used has the formula I

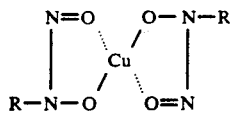

I in which each R is $C_1$–$C_{20}$-alkyl, $C_3$–$C_{20}$-alkenyl, $C_7$–$C_{12}$-aralkyl, $C_5$–$C_{12}$-cycloalkyl or aryl, of which the cycloalkyl may be substituted by up to 3 $C_1$–$C_4$-alkyl groups and the aryl by up to 3 $C_1$–$C_{12}$-alkyl groups, $C_1$–$C_{12}$-alkoxy groups, $C_2$–$C_8$-alkenyl groups, or chlorine or amino radicals.

3. A process as claimed in claim 2, wherein R is phenyl or cyclohexyl.

4. A process as claimed in claim 1, wherein the polyamide substrate is a sheetlike structure consisting of or containing polyamide fiber material.

5. A dye formulation for dyeing a polyamide substrate, containing a copper complex of an organic N-nitrosohydroxylamine as light stabilizer for the dyed polyamide.

* * * * *